United States Patent [19]

Busch

[11] 4,043,440

[45] Aug. 23, 1977

[54] PAPER FEED AND WEB REWIND MECHANISM

[75] Inventor: Richard E. Busch, La Puente, Calif.

[73] Assignee: Addmaster Corporation, San Gabriel, Calif.

[21] Appl. No.: 674,900

[22] Filed: Apr. 8, 1976

[51] Int. Cl.[2] ..... B65H 17/04; B41J 15/16

[52] U.S. Cl. ..... 197/114 R; 197/133 R; 101/228

[58] Field of Search ..... 197/114 R, 133 R, 127 R, 197/132, 134, 158, 157; 101/228, 336

[56] References Cited

U.S. PATENT DOCUMENTS

| | | | |
|---|---|---|---|
| 2,102,694 | 12/1937 | Garbell | 197/132 |
| 2,318,000 | 5/1943 | Lippert | 197/114 R |
| 2,787,357 | 4/1957 | Segui | 197/133 R |
| 3,217,855 | 11/1965 | Haberkorn et al. | 197/114 R |
| 3,429,523 | 2/1969 | Busch | 197/133 R UX |
| 3,782,521 | 1/1974 | Hengelhaupt | 197/158 |

*Primary Examiner*—Clifford D. Crowder
*Attorney, Agent, or Firm*—Fred N. Schwend

[57] ABSTRACT

A paper rewind roll drive for printers of the type in which the paper strip is advanced for both line spacing and to bring the last printed line to the viewing station and is thereafter retracted to position the next print line at the printing station, the drive comprising means for enabling the rewind roll to retract incrementally at the start of a print cycle, and a one-way drive effective after the usual paper advance following a printing operation to impel the rewind roll in an advancing movement with sufficient force to cause it to overtravel and thus take up any slack in the strip brought about by the usual line spacing advancement or otherwise.

10 Claims, 4 Drawing Figures

PAPER FEED AND WEB REWIND MECHANISM

BACKGROUND OF THE INVENTION

1. Field of the Invention

This invention relates to paper feed mechanism for data printers or the like incorporating a rewind roll for accumulating the paper after it has been printed, and has particular reference to paper rewind roll drive means for printers in which the paper is advanced to permit viewing the last printed amount and is subsequently retracted to properly position the next printing line at the printing station.

2. Description of the Prior Art

In certain types of data printers, the paper is positioned at a printing station during a printing operation and then, following a printing operation, the paper is advanced to a viewing station where the last amount printed can be viewed. Such advancement also includes the usual line spacing increment. Thereafter, as an incident to a new cycle of operation of the printer, the paper is retracted to return the last printed amount directly above the printing station to locate the next printing line at the printing station so that a new amount may be printed directly below the previously printed amount.

Such printers present a problem in driving a rewind roll for accumulating the paper after it is passed through the printing station. This is due to the fact that the rewind roll gradually increases in diameter and therefore the angular rotation of the rewind roll does not bear a direct relation to the linear movement of the paper through the printer. Further, certain printers, as exemplified by that disclosed in my copending U.S. patent application Ser. No. 491,871, filed on July 25, 1974, now U.S. Pat. No. 3,967,550 incorporate paper line feed mechanisms selectively capable of advancing the paper one, two or more increments as an incident to each printing operation. Thus, the paper rewind mechanism must be capable of accumulating the paper when fed in such different increments.

In addition, the paper might be manually advanced different amounts between cycles of operation. Also, for some reason, as when initially threading the paper through the printer, it may be left with an appreciable slack portion unaccumulated on the rewind roll.

Prior rewind mechanisms of the above type generally incorporated a yieldable drive mechanism, such as a slip clutch, for rotating the rewind roll. Although such yieldable drive mechanisms are generally satisfactory, they must provide sufficient driving force to adequately rotate the rewind roll when the paper wound thereon is of maximum diameter, i.e. when the moment arm formed by the radius of the rewind paper roll is greatest. However, when only a small amount of paper is accumulated on such rewind roll, i.e. when the moment arm formed by the radius of the paper is the smallest, the same tension is applied to the paper, and in extreme cases, this force may be sufficient to pull the paper through the normal paper feed mechanism or it could conceivably tear the paper. In any event, such prior rewind drive mechanisms tend to apply undue strain to the drive mechanism and to the guide means for the paper. This condition is aggrevated by the increased mass of the paper as it is accumulated on the rewind roll.

SUMMARY OF THE INVENTION

A principal object of the present invention is to provide a paper rewind drive mechanism for a printer of the above type which is capable of handling relatively large diameter rewind rolls.

Another object is to reduce the tendency for a rewind drive mechanism to pull the paper past the conventional paper feed mechanism in printers of the above type.

Another object is to reduce the loads normally encountered in driving rewind rolls for printers of the above type.

Another object is to provide a simple, compact reliable and economically manufactured paper rewind drive mechanism.

According to the present invention, the rewind roll is unwound somewhat by driving the same through a light yieldable slip clutch device prior to a retracting movement of the paper by the conventional paper feed mechanism to carry the last printed line from a viewing station to a position directly above the printing station so that a new amount may be printed on a line directly below such last printed line. This aids the natural tendency of the paper, because of its appreciable stiffness, to cause some unwinding of the rewind roll so that the conventional paper feed mechanism is relieved of the strain of unwinding such roll.

Subsequent to the usual advancement of the paper by the conventional paper feed mechanism to carry the last printed amount to the viewing station, the rewind roll is impelled by driving the same through a ratchet clutch with sufficient force to cause the same to overtravel and thus take up any slack in the paper caused by advancement of the same past the printing station. Because of its overtravel, the rewind roll may also take up any excessive slack in the paper brought about by conditions other than that occasioned by the usual paper advancement movement.

BRIEF DESCRIPTION OF THE DRAWING

The manner in which the above and other objects of the invention are accomplished will be readily understood on reference to the following specification when read in conjunction with the accompanying drawings, wherein.

DESCRIPTION OF THE PREFERRED EMBODIMENT

Figure 1:
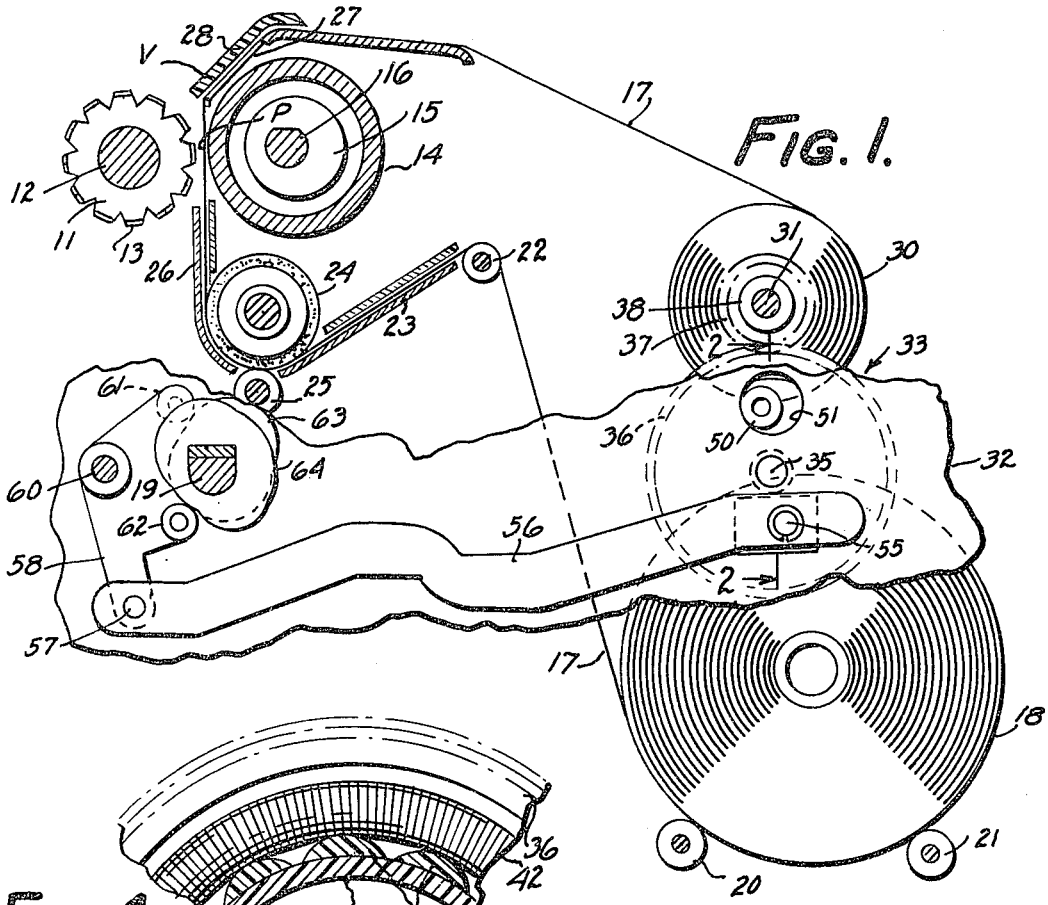
FIG. 1 is a sectional elevational view through a data printer embodying a preferred form of the present invention.

Referring to the drawing, the rewind drive mechanism of the present invention is shown associated with a cyclically operable printer of the type disclosed and claimed in my above mentioned U.S. Pat. No. 3,967,550, which printer is used by bank tellers or the like in printing amounts on customer's bankbooks and on a record tape which must be rewound and saved for accounting or other purposes. The disclosure of said patent is incorporated herein by reference. However, it is to be understood that the present rewind drive mechanism can equally well be applied to cash registers and other business machines which have provisions for rewinding the tape.

The printer comprises a plurality of type wheels, one of which is shown at 11, independently rotatably mounted on a stationary shaft 12. Such type wheels are rotated by setting mechanism (not shown) to present different type characters 13 to a printing station or line P. A printing platen 14 is rotatably mounted on eccentrics 15 carried by a printer shaft 16. The latter is driven through means (not shown) by a main shaft 19 which rotates clockwise one revolution during each cycle of the printer.

A paper record tape 17 is supplied on a supply roll 18 which rests on a pair of freely mounted rollers 20 and 21. The leading end of the tape 17 is fed over a guide roller 22 and through a guide chute 23 to a paper feed roller 24 against which the tape is held by a pressure roller 25. Thereafter, the tape is guided upwardly through a guide chute 26, intermediate the platen 14 and type wheels 11 and over a fixed guide plate 27 from whence it advances onto a paper rewind roll 30. A transparent tear-off bar 28 is located over the plate 27 to permit the operator to view printed amounts on the portion of the tape passing over the plate 27.

During a printing operation which occurs midway in a cycle of the printer, the printer shaft 16 is rotated one revolution, causing the platen 14 to advance laterally toward the type wheels 11 to transfer a printing impression from the aligned type characters 13 at the printing station P onto the tape 17.

Toward the end of the printing cycle, and after the printing operation, the paper feed roller 24 is advanced clockwise a sufficient amount to advance the paper to carry the last amount printed from the printing station P to a viewing station V where the operator can view such amount. At the beginning of the next cycle of the printer, the paper feed roll 24 is retracted counterclockwise to likewise retract the paper by an amount sufficient to carry the last printed line to a position directly above the printing station P so that the next amount will be printed directly therebelow. In certain modes of the printer, the paper feed roll 24 may be advanced clockwise more or less than three increments to space the print lines different distances.

Figure 2:
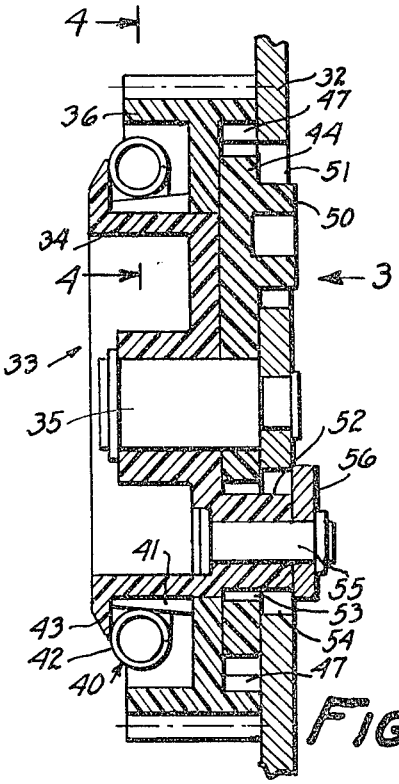
FIG. 2 is a transverse sectional view through the paper rewind mechanism and is taken substantially along the line 2—2 of FIG. 1.
Figure 3:
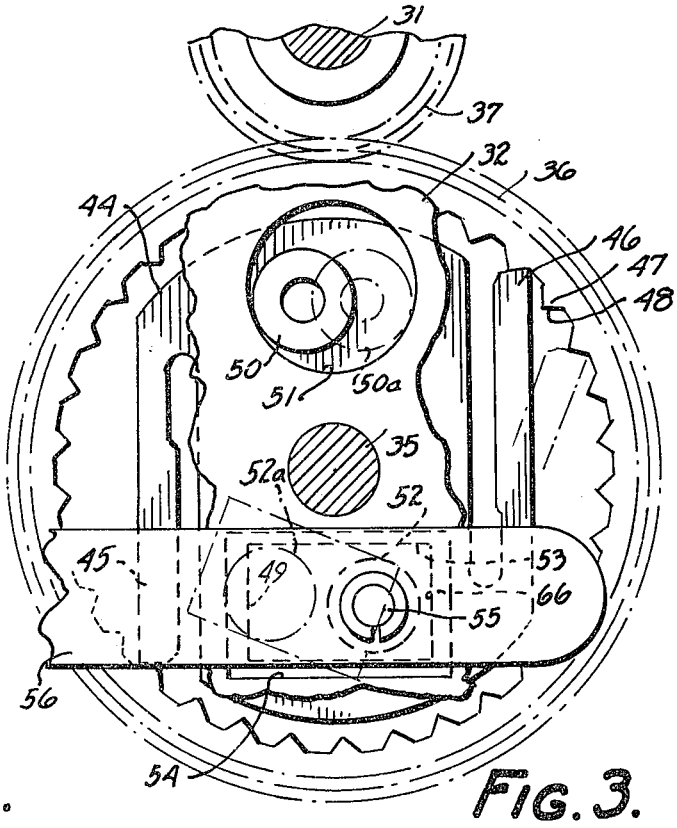
FIG. 3 is a side view of the paper rewind mechanism and is taken in the direction of the arrow 3 of FIG. 2.

The paper rewind roll 30 is wound on a core 38 rotatably mounted on a spindle 31 supported by bearings (not shown) formed in printer side frame plates, one of which is shown at 32 in FIGS. 2 and 3.

According to the present invention, means are provided to allow counterclockwise rotation of the rewind roll 30 shortly after the start of a printer cycle to facilitate retraction of the tape by the feed roll 24 prior to the printing operation, and subsequently, toward the end of the cycle, to impart clockwise rotational energy to the roll 30 to take up any slack in the tape brought about by advancement thereof past the printing station by the feed roll 24 following a printing operation or brought about otherwise.

For this purpose, a rewind drive mechanism generally indicated at 33 is provided, comprising a drum 34 rotatably mounted on a frame stud 35 and attached to the side frame 32. A gear member 36, preferably of plastic, is rotatably mounted on the periphery of the drum 34 and meshes with a gear 37 fastened to the core 38 of the rewind roll 30.

Figure 4:
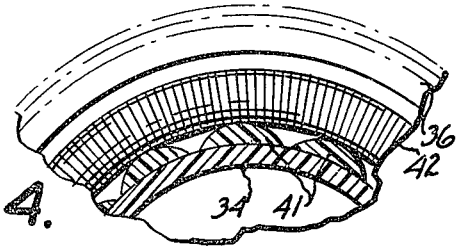
FIG. 4 is a fragmentary sectional view through the friction clutch device and is taken along the line 4—4 of FIG. 2.

A light friction or slip clutch generally indicated at 40 is provided to transmit rotation between the drum 34 and gear 36 and comprises a plurality of yieldable fingers 41 extending laterally from the gear 34 and frictionally engaging the outer periphery of the drum 34. A toroidal helically wound spring 42 is tensioned over the fingers 41 as shown in FIG. 4, and is retained in place by an annular flange 43 formed on the drum 34.

A plastic pawl member 44 is pivotally mounted on the frame stud 35 intermediate the drum 34 and frame plate 32. Pawl member 44 is rockable independently of drum 34 and carries oppositely disposed pawl fingers 45 and 46 which yieldably engage internal ratchet teeth 47 formed on gear 36. The ratchet teeth are formed with tooth surfaces 48 which, when engaged by the pawl fingers, extend at right angles to the length of such pawl fingers so that advancement of the pawl member 44 in a counterclockwise direction will positively advance the gear 36. However, the pawl fingers will be effective to transmit only a light yieldable drive to the gear 36 when the pawl member is advanced in a clockwise direction. In that case, the teeth 47 will merely rasp over the pawl fingers 45 and 46 when the gear 36 moves counterclockwise relative to pawl member 44. Thus, pawl member 44 and gear 36 form a one way clutch for driving the rewind roll 30.

A boss 50 formed on the pawl member 44 extends within an enlarged opening 51 in the side frame 32 to limit the extent of angular movement of the pawl member.

Drum 34 is oscillated once during each printer cycle and for this purpose it is provided with a hub 52 extending through rectangular openings 53 and 54 formed in the pawl member 44 and side frame 32, respectively. A pin 55 extending through the hub 52 pivotally connects the drum 34 to one end of a drive link 56. The latter is pivotally connected at its opposite end at 57 to a cam follower lever 58 fulcrummed at 60 and provided with rollers 61 and 62 which engage complementary cams 63 and 64 keyed on the aforementioned main printer shaft 19. Thus, the link 56 and drum 34 comprise an oscillating drive means.

Describing now the operation of the rewind mechanism, shortly after the start of a printer cycle, the cams 63 and 64 cause the link 56 to move leftward, rocking drum 34 clockwise, as viewed in FIGS. 1 and 3. If the mass of the tape accumulated on the roll 30 is sufficiently low, the friction clutch 40 will transmit clockwise rotation to the gear 36, unrolling rewind roll 30 counterclockwise sufficiently to permit the tape to be retracted by the paper feed roller 24 without interference by the rewind roll. In this case, gear 36, through ratchet teeth 47 will drive the pawl member 44 clockwise until boss 50 is arrested in its dot-dash line position 50*a*.

In the event the mass of the paper accumulated on rewind roll 30 is such that the clutch 40 will unduly slip, the hub 52 will strike the left hand edge 49 of opening 53 in the pawl member 44 and thus positively drive the pawl member into its clockwise rocked position. Further leftward movement of the link 56 causes the clutch 40 to further slip until the link reaches its left most position wherein the hub 52 assumes its dot-dash line position 52*a*. During this movement, the pawl fingers 45 and 46 will to some extent aid the clutch 40 in rotating the gear 36 to incrementally unwind roll 30.

In the case where the mass of the accumulated paper on the rewind roll causes slippage of the clutch 40, the diameter of the roll will have become large enough so that the inherent stiffness of the paper itself will unwind the roll, when permitted to do so by clockwise rocking of the pawl member 44. This unwinding will be sufficient to provide enough slack in the paper to permit retraction by the feed roller 24 without interference by the rewind roll.

Toward the end of the printer cycle, and after the tape 17 has been advanced through the printer by the feed roller 24 to locate the last printed amount at the viewing station V, the cams 63, 64 return the link 56 sharply to the right. At this time, the clutch 40 will attempt to transmit a counterclockwise rocking movement to the gear 36. Due to the clutching action between the pawl fingers 46 and the ratchet teeth 47, the gear 36 will return the pawl member 44 counterclockwise to its full line position of FIG. 3. If the clutch 40 should slip due to the accumulated mass of paper on the rewind roll, the boss 52 will strike the right hand edge 66 of opening 53 in the pawl to positively rock the pawl member counterclockwise and thereby transmit a positive drive to the gear 36 to advance the rewind roll clockwise. This movement will be forceful enough to cause the gear 36 to overtravel, during which overtravel movement the teeth 47 will merely rasp over the pawl fingers 45 and 46 so that the roll 30 will take up any excessive amount of slack in the tape 17 existing between the feed roll 24 and the take up roll. Thus, the boss 52 and the spaced edges 49 and 66 of the opening 53 form a lost-motion connection between link 56 and the pawl member 44. Any counterclockwise rebounding of the roll 30 due to abrupt stopping thereof by the tape 17, will be prevented by engagement of the pawl fingers 45 and 46 against the surfaces 48 of ratchet teeth 47. Thus, the tape 17 will be retained in its illustrated relatively taut condition until the start of a subsequent printer cycle.

It will be obvious to those skilled in the art that many variations may be made in the exact construction shown without departing from the spirit and scope of this invention.

I claim:

1. In a printer having mechanism for printing characters onto a record strip at a printing station, feed means for advancing said strip to carry said characters from said printing station to a viewing station and for thereafter retracting said strip, and means forming a rewind roll for said strip;

a rewind drive mechanism for said roll comprising an oscillating drive means, means comprising a one-way drive device operable in an advancing direction to impel said rewind roll to take up a certain amount of slack in said strip resulting from advancement of said strip by said feed means, and means operable by said drive means when moving in one direction for actuating said drive device in said advancing direction thereof, the mass of said rewind roll being effective to cause said rewind roll to overtravel relative to said drive device whereby to take up any remaining slack in said strip.

2. A rewind mechanism as defined in claim 1 wherein said last mentioned means comprises a lost motion device.

3. In a printer having mechanism for printer characters on a record strip at a printing station, feed means for advancing said strip to carry said characters from said printing station to a viewing station and for thereafter retracting said strip, and means forming a rewind roll for said strip;

a rewind drive mechanism for said roll comprising an oscillating drive means, means including a yieldable clutch operable by said drive means when moving in a first direction to enable said roll to unroll to permit said feed means to retract said strip, and means comprising a one-way drive device operable by said drive means when moving in the opposite direction to impel said rewind roll to take up a certain amount of slack in said strip resulting from advancement of said strip by said feed means.

4. A rewind drive mechanism as defined in claim 3 wherein the mass of said rewind roll is effective to cause said rewind roll to overtravel relative to said drive device whereby to take-up any remaining slack in said strip.

5. A rewind drive mechanism as defined in claim 3 wherein said one-way drive device comprises means including a member operatively connected to said rewind roll and having ratchet teeth thereon and a pawl member operable by said drive means and engageable with said teeth, said pawl member positively engaging said teeth upon movement of said drive means in said opposite direction and ratcheting over said teeth upon movement of said drive means in said first direction.

6. A rewind drive mechanism as defined in claim 5 comprising a lost motion connection between said drive means and said one-way drive device.

7. A rewind drive mechanism as defined in claim 6 comprising means for limiting movement of said pawl member in the opposite direction.

8. In a printer having mechanism for printing characters onto a record strip at a printing station, feed means for advancing said strip to carry said characters from said printing station to a viewing station and for thereafter retracting said strip, and means forming a rewind roll for said strip;

a rewind drive mechanism for said roll comprising oscillating drive means, means comprising a rotatable driven member operatively connected to said rewind roll, means comprising a yieldable clutch operable by said drive means when moving in one direction for rotating said driven member to cause said rewind roll to unwind said strip, said driven member having ratchet teeth thereon, a pawl member rotatable about the axis of rotation of said driven member, said pawl member being engageable with said ratchet teeth, and means operable by said drive means when moving in the opposite direction for rotating said pawl member to drive said driven member whereby to cause said rewind roll to roll a certain amount of slack portion of said strip thereon.

9. A rewind drive mechanism as defined in claim 8 wherein said pawl member is effective to overdrive said driven member and said rewind roll whereby to take up any slack in said strip.

10. A rewind drive mechanism as defined in claim 8 wherein said last mentioned means comprises a lost motion connection.

* * * * *